US006761101B1

(12) United States Patent
Luth

(10) Patent No.: US 6,761,101 B1
(45) Date of Patent: Jul. 13, 2004

(54) FIREARMS RECEIVER BLOCK AND METHOD OF USING SAME

(76) Inventor: Randy E. Luth, 10944 147$^{th}$ Ave. SE., Becker, MN (US) 55308

( * ) Notice: Subject to any disclaimer, the term of this patent is extended or adjusted under 35 U.S.C. 154(b) by 0 days.

(21) Appl. No.: 10/436,576

(22) Filed: May 13, 2003

(51) Int. Cl.$^{7}$ ..... F41A 23/00

(52) U.S. Cl. ..... 89/37.04; 42/95; 269/54; 269/54.5

(58) Field of Search ..... 89/37.04; 42/95; 269/54, 54.5

(56) References Cited

U.S. PATENT DOCUMENTS

| | | | | |
|---|---|---|---|---|
| 1,457,407 | A | * | 6/1923 | Stokes ..... 89/37.04 |
| 2,427,365 | A | | 9/1947 | Meister |
| 4,824,086 | A | | 4/1989 | Rickling et al. |
| 4,841,839 | A | | 6/1989 | Stuart |
| 4,873,777 | A | | 10/1989 | Southard |
| 5,142,806 | A | | 9/1992 | Swan |
| 5,375,804 | A | | 12/1994 | Levilly |
| 5,410,834 | A | | 5/1995 | Benton et al. |
| 5,533,292 | A | | 7/1996 | Swan |
| D384,498 | S | | 10/1997 | Hughes et al. |
| 5,907,919 | A | | 6/1999 | Keeney |
| 6,272,785 | B1 | | 8/2001 | Mika et al. |
| 6,293,041 | B2 | | 9/2001 | Weaver |
| D459,625 | S | | 7/2002 | Zebbedies |

FOREIGN PATENT DOCUMENTS

| | | | |
|---|---|---|---|
| RU | GB1737 | * | 8/1911 |

OTHER PUBLICATIONS

DPMS Panther Receiver Claw offer for sale advertisement, www.del0ton.com, (date unknown).*

* cited by examiner

*Primary Examiner*—Michael J. Carone
*Assistant Examiner*—Troy Chambers
(74) *Attorney, Agent, or Firm*—McKee, Voorhees & Sease, P.L.C.

(57) ABSTRACT

A receiver block particularly configured for an AR-15/M-16 receiver includes an upwardly extending tongue adapted to be received in the receiver cavity with oppositely positioned ears on the receiver being received in apertured slots on the receiver block with pins being received in the aligned openings to lock the receiver to the receiver block thereby providing substantially total exposure and access to the receiver.

2 Claims, 4 Drawing Sheets

FIREARMS RECEIVER BLOCK AND METHOD OF USING SAME

BACKGROUND OF THE INVENTION

Gunsmithing procedures performed on AR-15/M-16 firearms heretofore have involved holding the firearm in a vise with the vise jaws either engaging the barrel of the firearm or the jaws of an action block embracing the receiver of the firearm.

Such an action block is sold by Brownell's, Inc., Montezuma, Iowa and is identified as Peace River Arms AR-15/M-16 receiver action block. This prior art action block works well but encloses a substantial part of the upper receiver thereby limiting access to the upper receiver.

What is needed is a receiver block which will securely hold the receiver in a vise leaving the substantial exterior of the receiver exposed for performing gunsmithing operations.

BRIEF SUMMARY OF THE INVENTION

The receiver block of this invention may be used with any receiver having a cavity positioned between a pair of apertured ears such that an upwardly extending tongue on a receiver block may be received in the receiver cavity with the apertured ears being received in apertured slots in the block for pins to be inserted therethrough thereby locking the receiver to the block which in turn would be held securely by being placed in a vise engaging only the lower base portion of the block.

The receiver block of this invention is however particularly well suited for the upper receiver of AR-15/M-16 firearms as the tongue is configured to the internal shape of the receiver cavity and the apertured slots are positioned to receive the apertured ears on the upper receiver at opposite ends of the cavity.

It is thus seen that use of the receiver block of this invention will provide rigid holding of the receiver while providing substantially total access to the receiver for performing gunsmithing operations.

DETAILED DESCRIPTION OF THE PREFERRED EMBODIMENT

Figure 1:
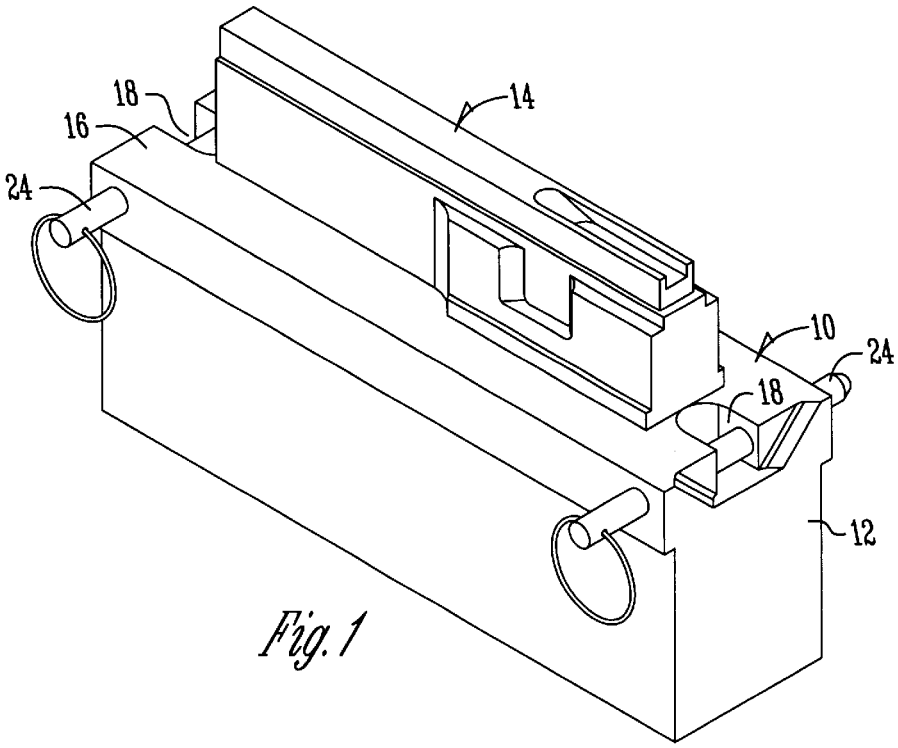
FIG. 1 is a perspective view of the receiver block of this invention.
Figure 2:
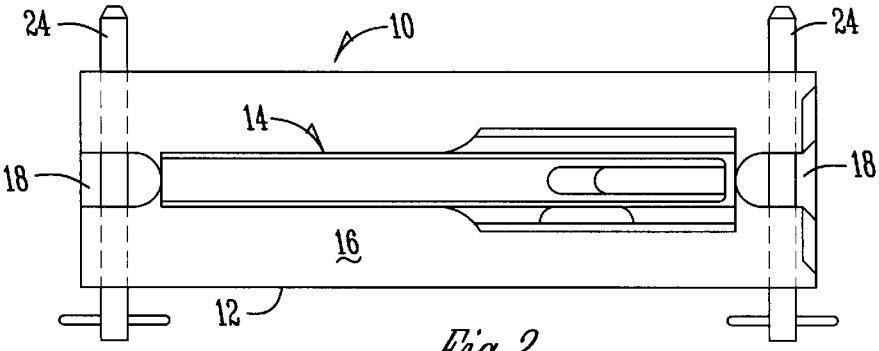
FIG. 2 is a top plan view thereof.
Figure 3:
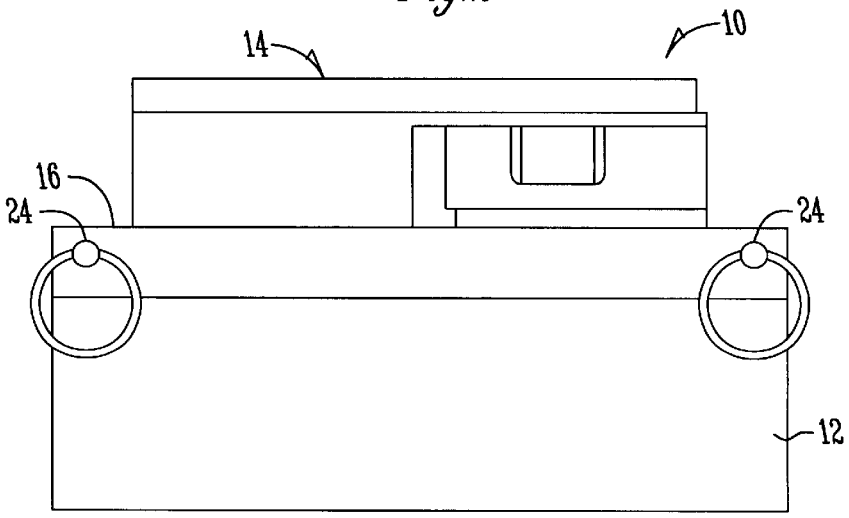
FIG. 3 is a front side elevational view thereof.
Figure 4:
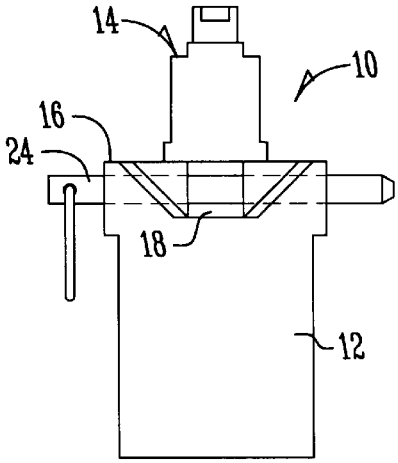
FIG. 4 is a right end elevational view thereof as viewed in FIG. 1.
Figure 5:
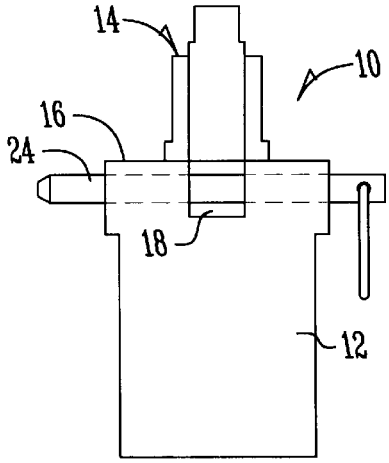
FIG. 5 is a left end elevational view thereof as viewed from the left end of FIG. 1.
Figure 6:
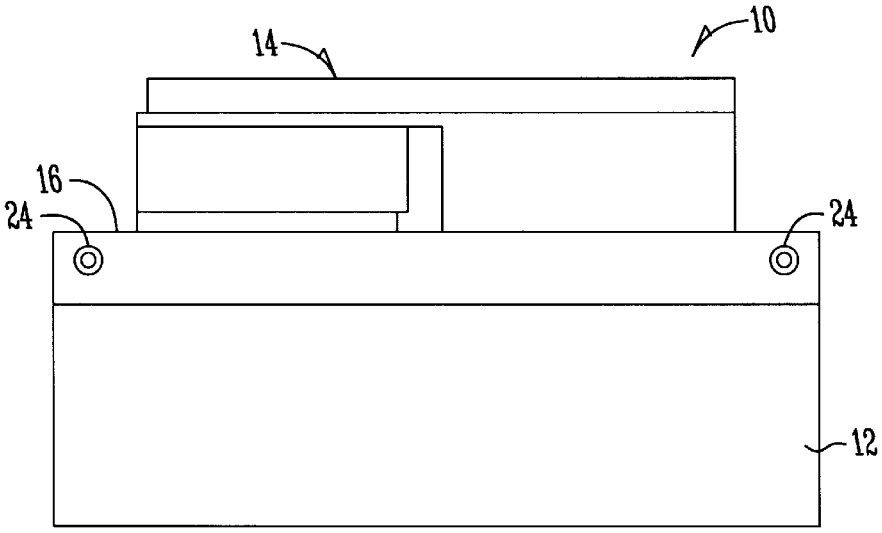
FIG. 6 is a back side elevational view thereof.
Figure 7:
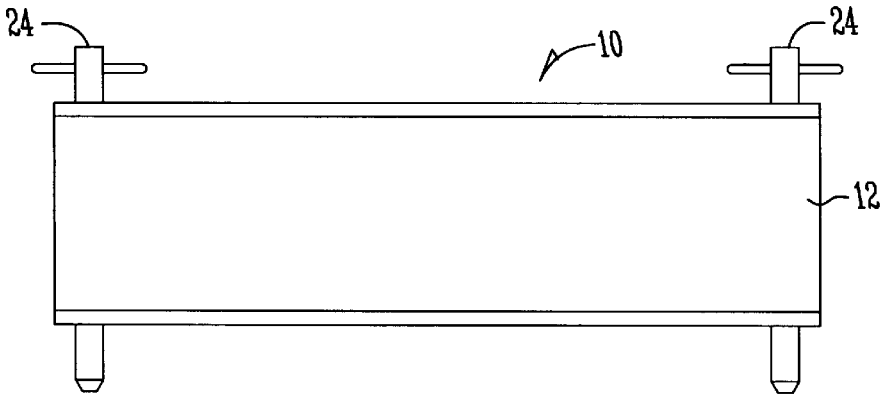
FIG. 7 is a bottom side plan view thereof.

The upper receiver block of this invention is referred to generally in FIG. 1 by the reference numeral 10 and includes a base portion 12 and an upper tongue portion 14 positioned on a top side 16 of the base 12.

The upper side 16 of the base 12 at opposite ends of the tongue 14 includes slots 18 which open upwardly and horizontally outwardly.

Figure 8:
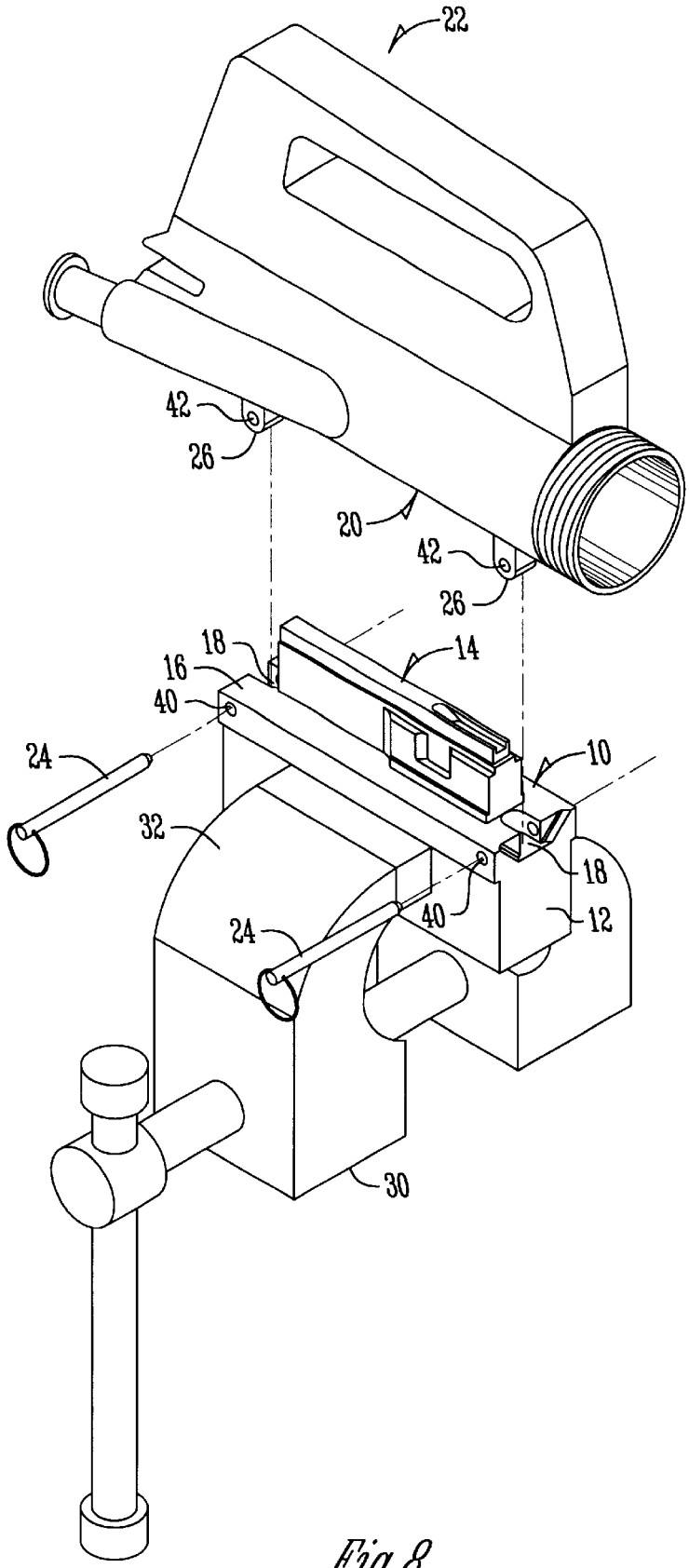
FIG. 8 is an exploded perspective view of an upper receiver positioned to be mounted on a receiver block positioned in a vise.
Figure 9:
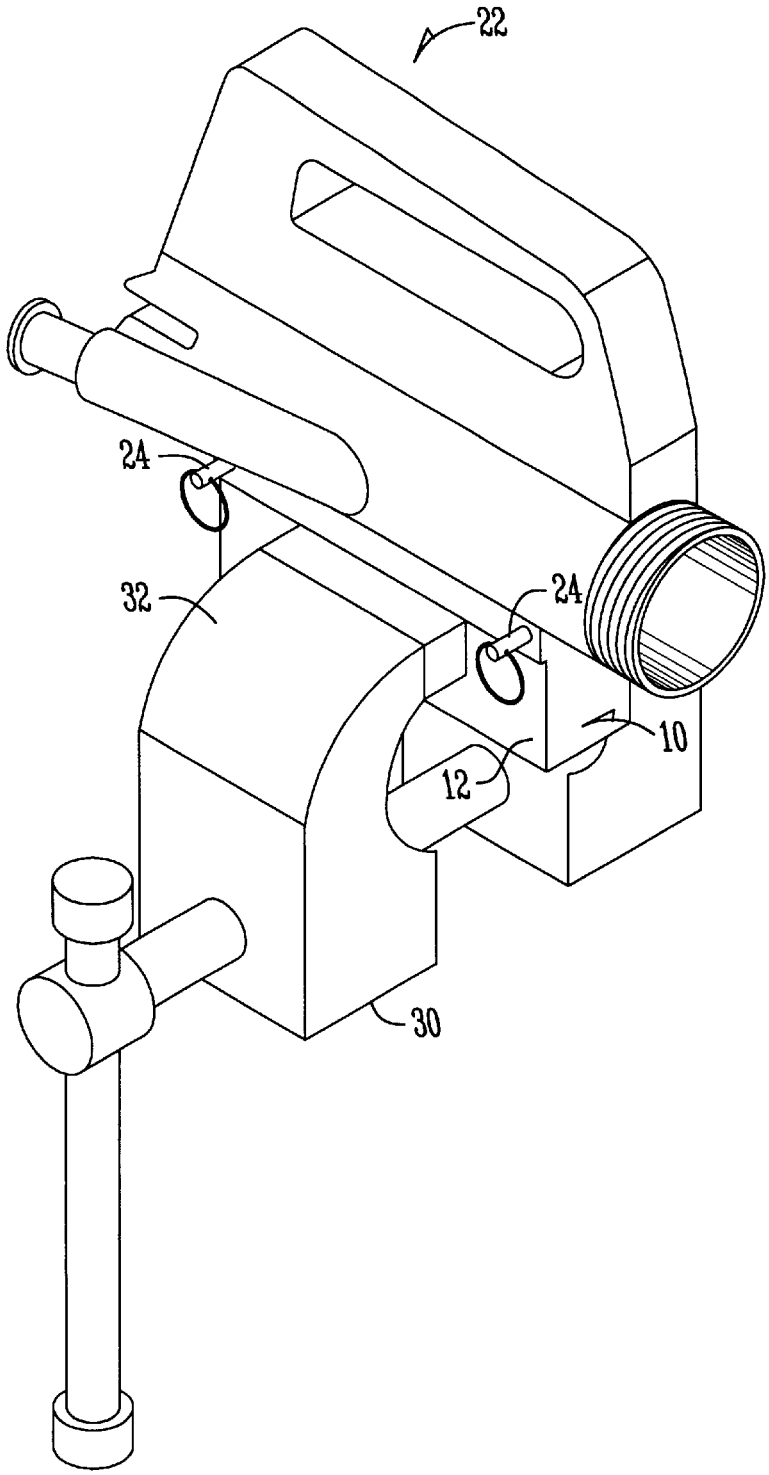
FIG. 9 is a perspective view of the upper receiver mounted on the receiver block in turn being held in a vise.

The tongue 14 is shaped to matingly engage the interior cavity 20 of the upper receiver 22 as shown in FIG. 8. Pins 24 are received in the apertured slots 18 and are adapted to be received in downwardly extending ears 26 on the upper receiver 22 as seen in FIGS. 8 and 9.

Thus in operation, the receiver block 10 would be placed in a vise 30 with the vise jaws 32 engaging the base portion 12 leaving the tongue 14 fully exposed above the vise 30. The upper receiver 22 is then lowered onto the receiver block 10 with the tongue 14 being received in the upper receiver cavity 20 and the ears 26 being received in the slots 18. The pins 24 are then inserted through aligned apertures 40 in the slots 18 and openings 42 in the ears 26. The upper receiver 22 is now rigidly held for performing gunsmithing operations with the upper receiver 22 being substantially fully exposed and accessible.

While a receiver block of this invention is particularly suited for use with the AR-15/M-16 upper receivers of which there are at the present time approximately six types. The receiver block could of course be used with any firearm receiver having the general configuration of the AR-15/M-16 upper receiver.

What is claimed is:

1. A method of using a firearms receiver block for performing gunsmithing procedures on a firearm comprising the steps of:

providing a receiver block having an upwardly extending tongue and apertured notches at opposite ends of said tongue;

providing a receiver having a cavity positioned between a pair of apertured ears;

positioning said receiver on said receiver block with said tongue positioned in said cavity and said ears received in said slots; and inserting pins through aligned openings in said slots and ears to lock said receiver to said receiver block.

2. The method of using the receiver block of claim 1 and the step of positioning the base of the receiver block in a vise and locking the vise to the receiver block.

* * * * *